US005314259A

United States Patent [19]

Nakajima et al.

[11] Patent Number: 5,314,259

[45] Date of Patent: May 24, 1994

[54] RECORDING APPARATUS HAVING AN IMPROVED MECHANISM FOR MOVING THE RECORDING SECTION THEREOF

[75] Inventors: Hiroharu Nakajima, Tokyo; Toshiaki Ozawa, Urayasu, both of Japan

[73] Assignee: Canon Kabushiki Kaisha, Tokyo, Japan

[21] Appl. No.: 860,122

[22] Filed: Mar. 31, 1992

Related U.S. Application Data

[63] Continuation of Ser. No. 667,372, Mar. 12, 1991, abandoned, which is a continuation of Ser. No. 420,748, Oct. 13, 1989, abandoned, which is a continuation of Ser. No. 163,127, Feb. 19, 1988, abandoned, which is a continuation of Ser. No. 907,170, Sep. 15, 1986, abandoned, which is a continuation of Ser. No. 648,957, Sep. 10, 1984, abandoned.

[30] Foreign Application Priority Data

Sep. 20, 1983 [JP] Japan ..... 58-172285

[51] Int. Cl.[5] ..... B41J 35/20

[52] U.S. Cl. ..... 400/216.2; 400/212

[58] Field of Search ..... 400/211, 50, 213, 213.1, 400/213.2, 215.3, 215.4, 216, 216.1, 216.2, 216.4, 216.6, 229, 257

[56] References Cited

U.S. PATENT DOCUMENTS

| | | | |
|---|---|---|---|
| 207,559 | 8/1878 | Sholes | 400/575.1 |
| 1,062,735 | 5/1913 | Ramsey | 400/215.2 |
| 1,950,762 | 3/1934 | Thompson | 400/216.2 |
| 2,602,530 | 7/1952 | Runde | 400/216.2 |
| 4,364,679 | 12/1982 | Longrod et al. | 400/215.3 |
| 4,425,046 | 1/1984 | Van Horne et al. | 400/229 |

FOREIGN PATENT DOCUMENTS

| | | | |
|---|---|---|---|
| 004818 | 3/1982 | European Pat. Off. | 400/229 |
| 2511138 | 9/1976 | Fed. Rep. of Germany | 400/212 |
| 55-74894 | 6/1980 | Japan | 400/212 |
| 162684 | 3/1982 | Japan | 400/216.2 |
| 103883 | 6/1982 | Japan | 400/123 |
| 2093406 | 9/1982 | United Kingdom | 400/215.3 |

OTHER PUBLICATIONS

D. G. Fitch et al. "Method of Detecting Printer Inactivity"; *IBM Technical Disclosure Bulletin;* vol. 26, No. 2, pp. 723-725; Jul. 1983.

"Automatic Platen Indexing System"; T. M. Paulson; *IBM Tech. Disc. Bull.;* vol. 18, No. 10, p. 3352, Mar. 1976.

*IBM Technical Disclosure Bulletin,* R. D. Mathews; "Ribbon Cartridge"; vol. 18, No. 11, p. 3538, Apr. 1976.

*Primary Examiner*—David A. Wiecking

*Attorney, Agent, or Firm*—Fitzpatrick, Cella, Harper & Scinto

[57] ABSTRACT

An improvement in movement of the recording section in a recording apparatus such as a typewriter, a printer or the like is provided. This recording apparatus comprises: a print ribbon cassette having a recording material; a carriage having a solenoid or a cam for moving the cassette; a detector for detecting the vertical or horizontal moving amount of the cassette; and a controller for controlling the moving condition of the cassette moved by the carriage on the basis of an output from the detector. The moving time of the ribbon cassette is changed in accordance with the typing speed of the operator or the size of character to be recorded. Thus, the whole printing time can be shortened and the noise generated in association with the typing operation can be reduced.

8 Claims, 9 Drawing Sheets

CONTROL MEANS CONTROLLING
LATCH MEANS TO STORE
A STANDARD TIME DURATION
DIFFERENT THEN THE DURATION
OF TIME HELD BY THE LATCH
MEANS AFTER THE ELAPSE OF
AN EXTENDED WAITING TIME
GREATER THAN THE TIME
COUNTED BY THE COUNTING MEANS

RECORDING APPARATUS HAVING AN IMPROVED MECHANISM FOR MOVING THE RECORDING SECTION THEREOF

This application is a continuation of application Ser. No. 07/667,372 filed Mar. 12, 1991, now abandoned, which in turn is a continuation of application Ser. No. 07/420,748 filed on Oct. 13, 1989, now abandoned, which in turn is a continuation of application Ser. No. 07/163,127 filed on Feb. 19, 1988, now abandoned, which in turn is a continuation of application Ser. No. 06/907,170 filed on Sep. 15, 1986, now abandoned, which in turn is a continuation of application Ser. No. 06/648,957 filed on Sep. 10, 1984, now abandoned.

BACKGROUND OF THE INVENTION

1. Field of the Invention

The present invention relates to a recording apparatus and, more particularly, to the movement of the recording section thereof.

2. Description of the Prior Art

In recording apparatuses such as, for example, thermal printers, wire-dot printers, and further, word-processors, a typewriters, etc., more functions and higher performance are being realized. Particularly, in a typewriter and the like which can edit and the like, the burden for the operator is reduced and persons other than the operators, who were specially and well trained, can make a high grade document.

However, among such many functions, there are also functions which are particularly useful for only the operators who are relatively experienced and which are not well suited for use by a beginner. Therefore, it is difficult for the beginner to use such an apparatus.

For example, the ribbon lifting operation when recording is also one of such inconvenient functions.

A typewriter as a conventional recording apparatus of this kind, in particular, will now be described with reference to FIGS. 1 to 3.

FIG. 1 is an illustration for explaining the external appearance of the typewriter. A keyboard 1 is disposed on the upper surface on this side of the typewriter. The recording is performed on a recording paper 4, wrapped around a platen 3, by a type wheel 6 attached to a carriage 2 which is reciprocated horizontally.

The type wheel 6 is disposed on the side of the platen 3 of the carriage 2 and is rotated by a motor (not shown).

FIG. 2 is a perspective view of the recording section and FIG. 3 is a side elevational view. A hammer unit 7 is disposed on this side of the type wheel 6. A hammer 7*a* is attached to the point of the hammer unit 7.

Also, a print ribbon cassette 8 is detachably attached over the carriage 2.

The print ribbon cassette 8 has left and right arms 8*a* and 8*b*. The print ribbon pulled out from the side of the arm 8*b* is led in the side of the other arm 8*a* and is wound in the print ribbon cassette 8. This print ribbon passes through the gap between the type wheel 6 and the platen 3 as indicated at a numeral 8*c* in FIG. 3.

On the other hand, the print ribbon cassette 8 is rotatably supported to the side of the carriage 2 through stub shafts 8*d*. When the cassette 8 is installed over the carriage 2, it is retained by hooks 5 so as not to be detached.

In addition, a torsion coil spring 10 is disposed below the print ribbon cassette 8. One end of the spring 10 is stopped on the carriage side, while the other is in contact with the bottom surface of the print ribbon cassette 8.

A solenoid 9 is disposed below the bottom surface on the side of the print ribbon cassette 8 near the print wheel 6. A rod 9*a* of the solenoid 9 is in contact with the bottom surface of the print ribbon cassette 8. When no current is supplied to the solenoid 9, the rod 9*a* is located in the lower position. In this state, the print ribbon cassette 8 is rotated clockwise in FIG. 3 by the torsion coil spring 10, so that the print ribbon 8*c* is in the state dropped from the printing position.

Upon printing, when a signal is inputted from the keyboard, the solenoid 9 is excited and the rod 9*a* is projected upwardly, so that the print ribbon cassette 8 is rotated counterclockwise in FIG. 3 and the print ribbon 8*c* reaches the printing position.

In this way, whenever the printing is performed by operating the keyboard, the print ribbon is lifted to the printing position and is immediately shifted from the printing position after the printing, thereby enabling the print to be checked.

However, this ribbon lifting operation has drawbacks such that the solenoid 9 has to be driven and extremely large noise is generated since the rod 9*a* is brought into contact with the print ribbon cassette 8.

Therefore, recently, in the case where the printing is continuously performed, the ribbon lifting operation is not performed for every character but printing is executed while the lifted state is held under electronic control.

Namely, when a signal from the next print key is inputted within a certain preset time interval after printing a prior character, the lifted state is maintained to eliminate the noise in association with the ribbon lifting operation and to eliminate the time necessary for the lifting, thereby realizing essentially silent and high-speed operation. FIG. 4 shows the flowchart in this case. In step 1, when a key signal is inputted, the ribbon shifting operation is performed in step 2. The type corresponding to the key input is selected from the type wheel 6 or the like in step 3. The printing hammer 7*a* is driven in step 4 and the next key signal is checked to see if it is inputted or not in step 5. If the next key signal is inputted, the processing is returned to step S2. If the next key signal is not inputted in step 6, the discrimination is made to see if the waiting time $t_n$ (e.g., 200 msec) has elapsed or not. If the waiting time $t_n$ has not elapsed yet, the processing will be returned to step 5. If it has elapsed, the ribbon dropping operation will be executed in step 7.

However, in the case where the characters which have been once stored in a memory by the key inputs are recorded and printed at once in the W/W mode (the recording is performed on a word unit basis), L/L mode (the recording is performed on a line unit basis), etc., the ribbon lifting operation is controlled and the printing can be performed while the ribbon is in the lifted state without carrying out the ribbon lifting and dropping operations whenever one character is printed. However, in the typewriters having only the ordinary C/C mode ( the recording is performed on a character unit basis) without such modes, the waiting time $t_n$ of FIG. 4 is determined on the basis of the experienced operator as a reference. If these typewriters are operated by a beginner whose printing operation speed is slow, the ribbon will have been lifted and dropped whenever the printing is performed, so that the noise is generated and the time necessary for lifting the ribbon is also added to the printing speed as a whole. Therefore, the typing speed will be slow.

SUMMARY OF THE INVENTION

The present invention is made in consideration of the above points and intends to eliminate the above-mentioned drawbacks.

It is an object of the invention to provide a recording apparatus in which the recording operation can be controlled in accordance with the user.

Another object of the invention is to provide a recording apparatus in which the noise generated upon recording is reduced.

Still another object of the invention is to provide a recording apparatus which can control the time regarding the lift and drop of a member supporting a recording medium.

A further object of the invention is to provide a recording apparatus which can change the moving condition of the member having a recording material.

Still further object of the invention is to provide a recording apparatus which can change the moving condition of the member having the recording material in dependence upon the recording operation or inputting operation or the like.

DETAILED DESCRIPTION OF THE PREFERRED EMBODIMENT

The present invention will now be described in detail hereinbelow with reference to the drawings.

Figure 1:
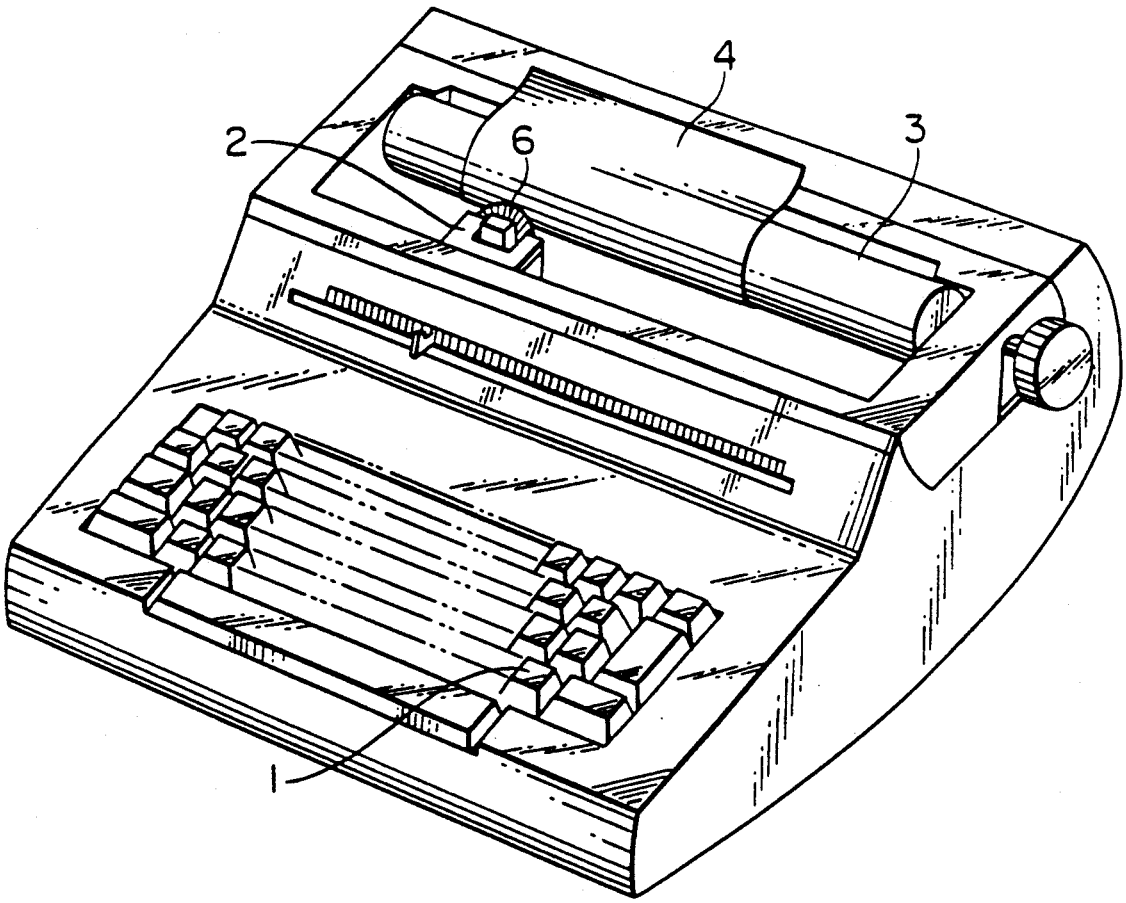
FIG. 1 PRIOR ART
FIG. 1 is a perspective view of a conventional recording apparatus.
Figure 2:
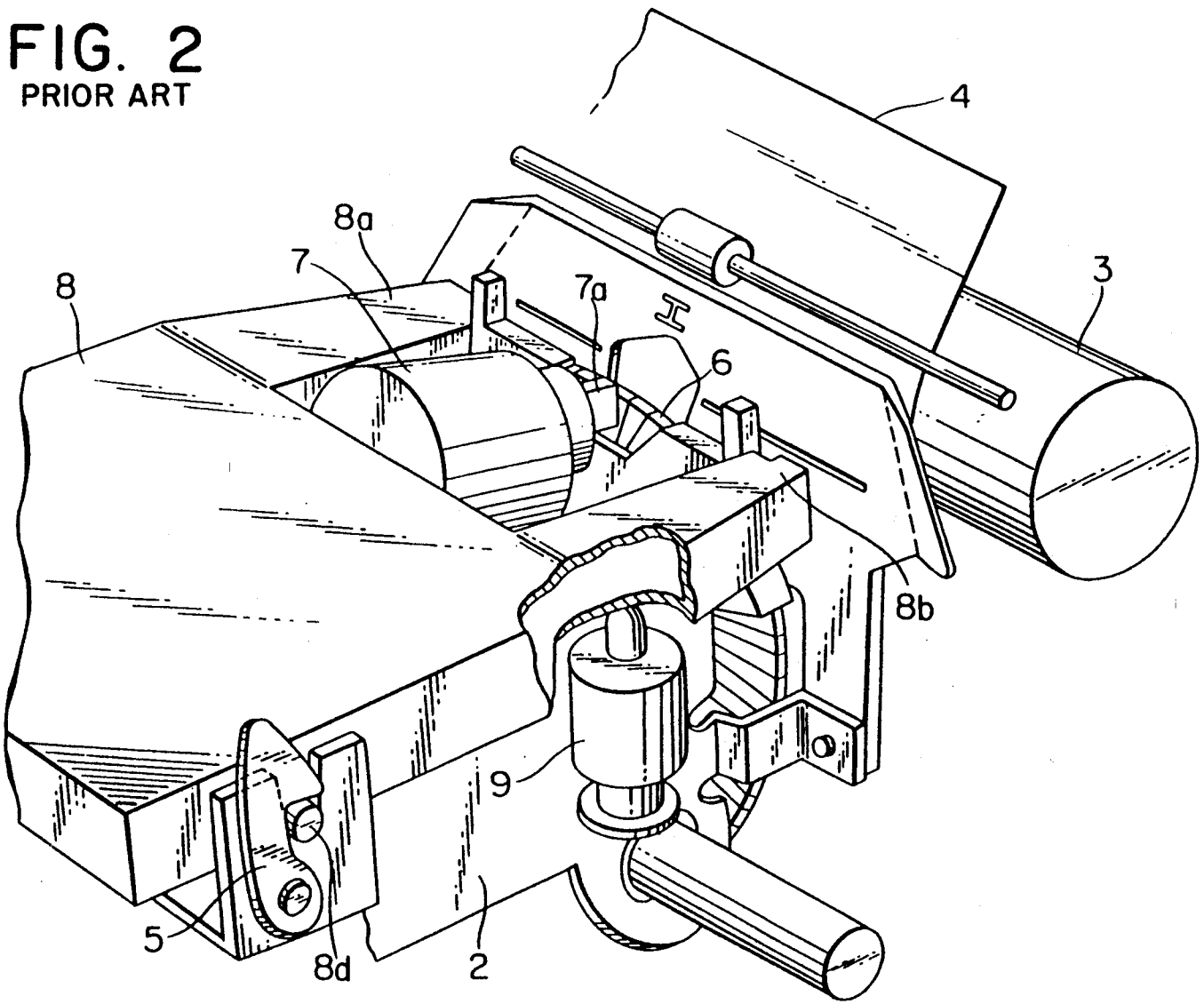
FIG. 2 PRIOR ART
FIG. 2 is a perspective view of the recording section.
Figure 3:
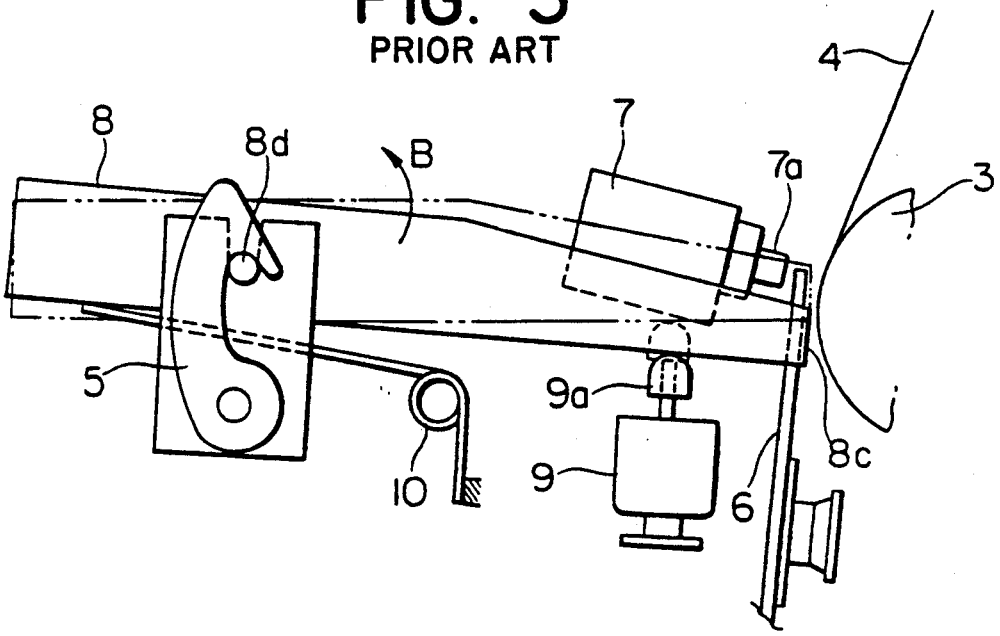
FIG. 3 PRIOR ART
FIG. 3 is a side elevational view of the recording section.
Figure 5:
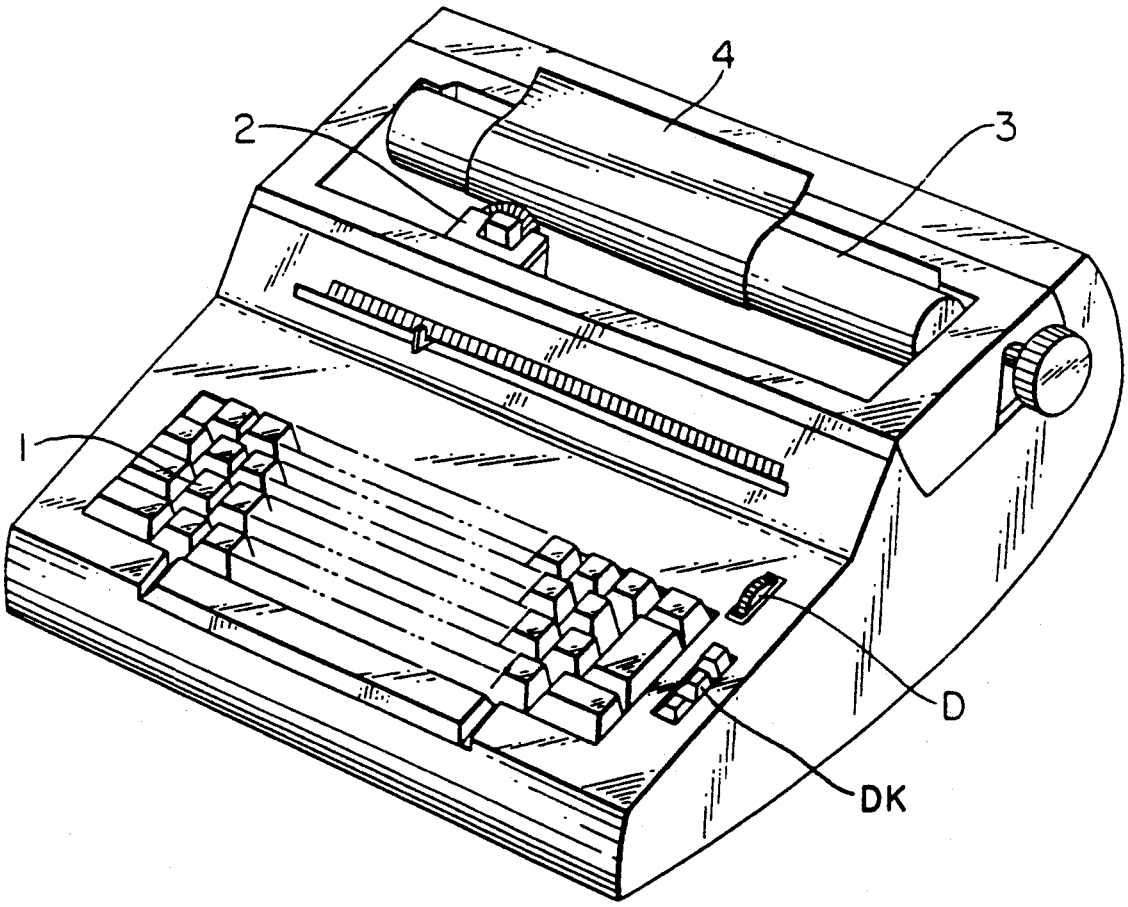
FIG. 5 is a perspective view of a recording apparatus to which the present invention is applied.
Figure 4:
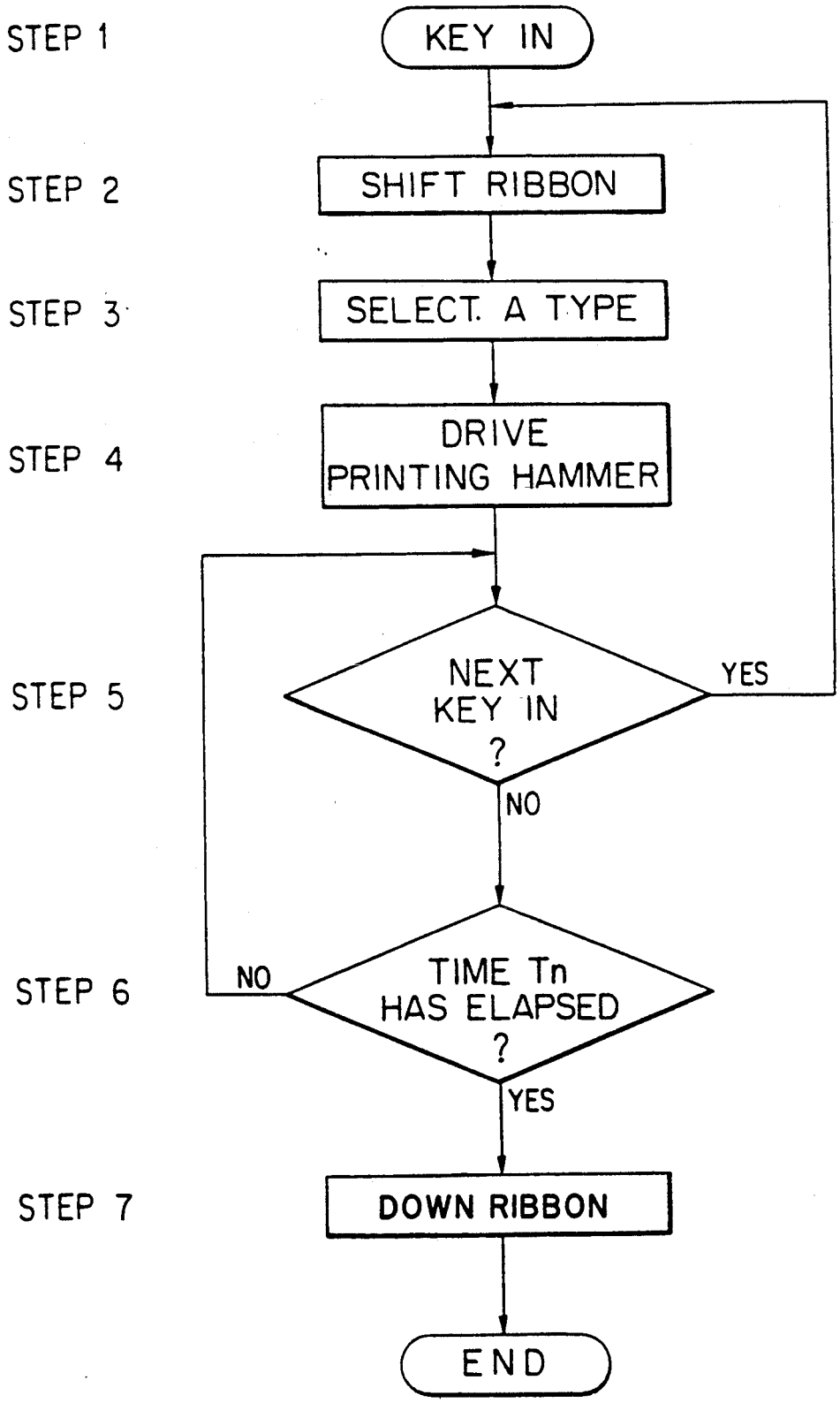
FIG. 4 PRIOR ART
FIG. 4 is a flowchart showing the recording sequence.
Figure 6:
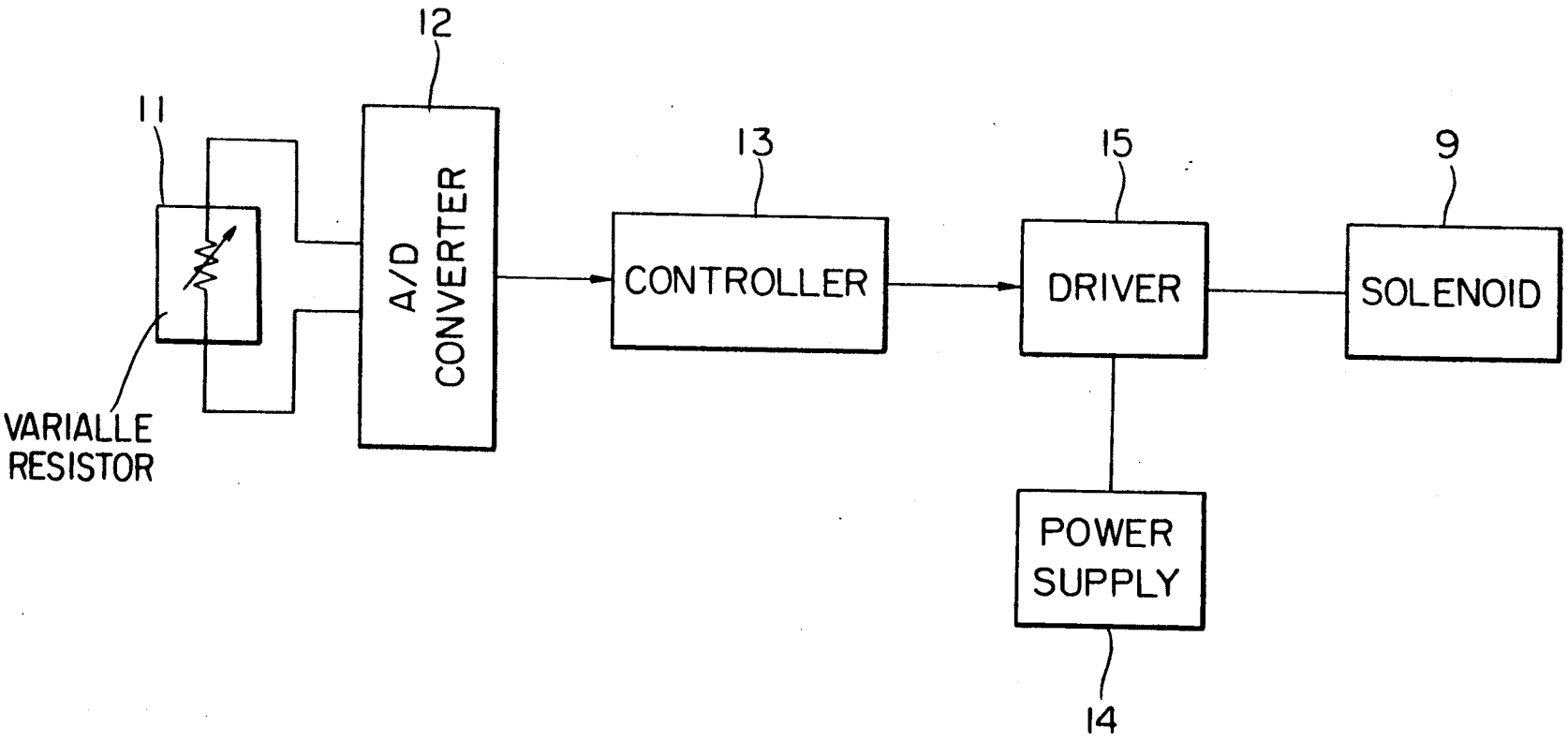
FIG. 6 is a control block diagram of the recording section.

FIGS. 5 and 6 are diagrams for explaining an embodiment of the invention, in which FIG. 5 illustrates an external view of a typewriter as an example of the recording apparatus and FIG. 6 is a control block diagram of the recording apparatus. In the diagrams, the same parts and components as those shown in FIGS. 1 to 3 are designated by the same reference numerals and their descriptions are omitted.

In this embodiment, a selector dial D is provided near the keyboard 1 as shown in FIG. 5. The holding time interval of the solenoid 9 is controlled by operating the selector dial D with the finger, thereby enabling the ribbon lifting movement in accordance with the capability of the operator to be performed. In addition, the selector dial D may be a button or numerical value inputting keys DK and is not limited to these.

Namely, the selector dial D is connected to a variable resistor 11 as shown in FIG. 6 and by controlling the variable resistor 11 through the selector dial D, the value of current outputted is changed. This current is converted to a digital signal by an A/D converter 12. This data is inputted to a controller 13. The controller 13 controls a driver 15 backed up by a power supply 14. Thus, the holding time of the solenoid 9 (or may be a pulse motor 18 which will be mentioned later) can be controlled (or may be controlled by means of the pulse motor 18 which will be explained later).

With such a structure, the holding time of the solenoid 9 can be freely selected by the operator himself in accordance with the capability of the operator, so that this makes it possible to allow the lifting operation of the ribbon, which is material for recording, to be performed in accordance with the capability of the operator.

Therefore, the generation of noise in association with the ribbon lifting operation as in the conventional recording apparatus is prevented, while the decrease in printing speed as a whole caused due to the ribbon lifting operation can be also suppressed. In addition, the time necessary for lifting and dropping the ribbon can be freely set by the operator, so that it is possible to allow the lifting operation of the print ribbon to be executed in accordance with the capability of the operator. The generation of noise in association with the lifting operation of the print ribbon can be prevented. The time required for the lifting operation of the print ribbon can be eliminated from the whole printing time interval, thereby enabling the whole printing time to be shortened.

Figure 7:
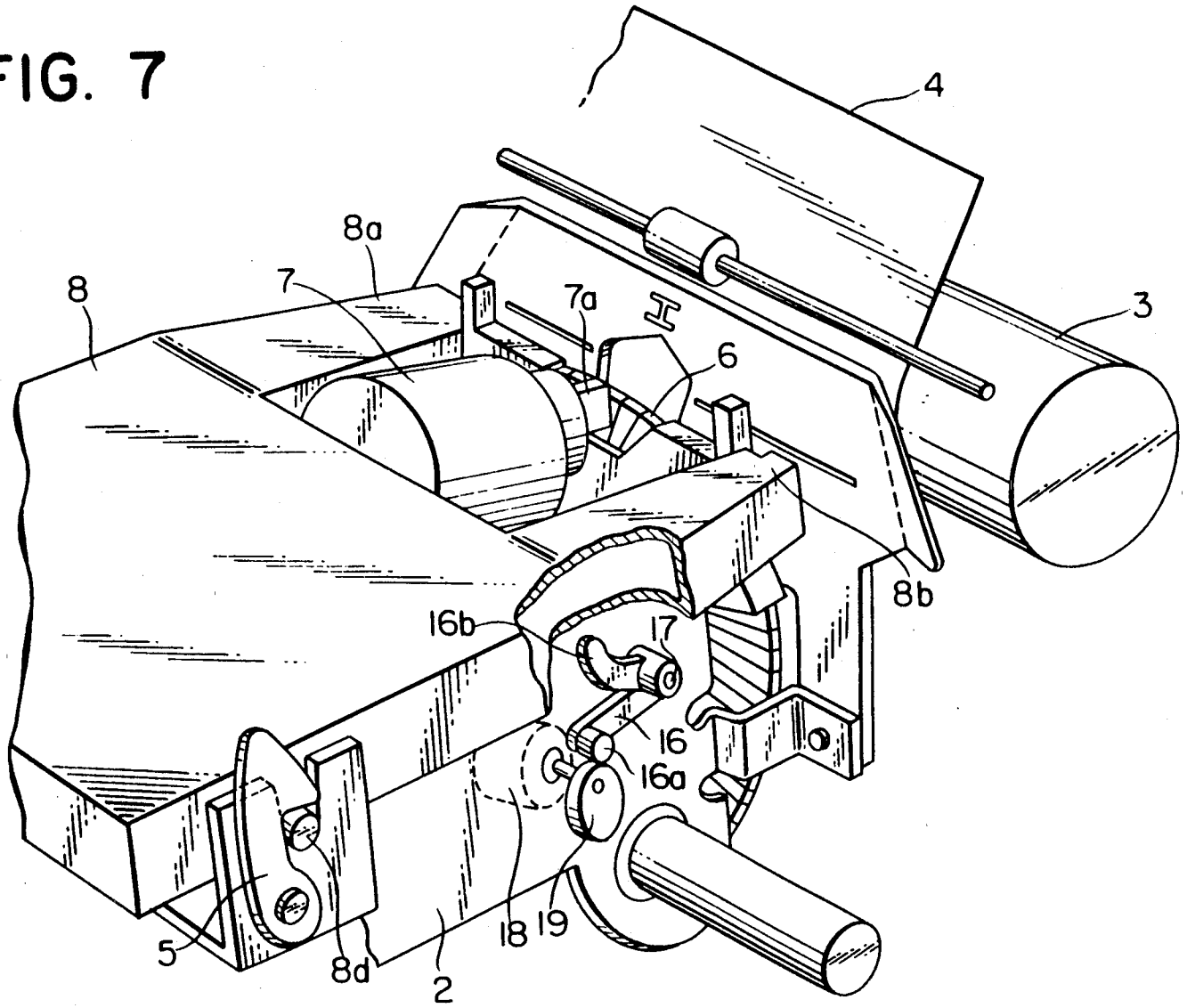
FIG. 7 is a perspective view of the recording section in case of lifting and dropping a ribbon by means of a pulse motor and a cam.
Figure 8:
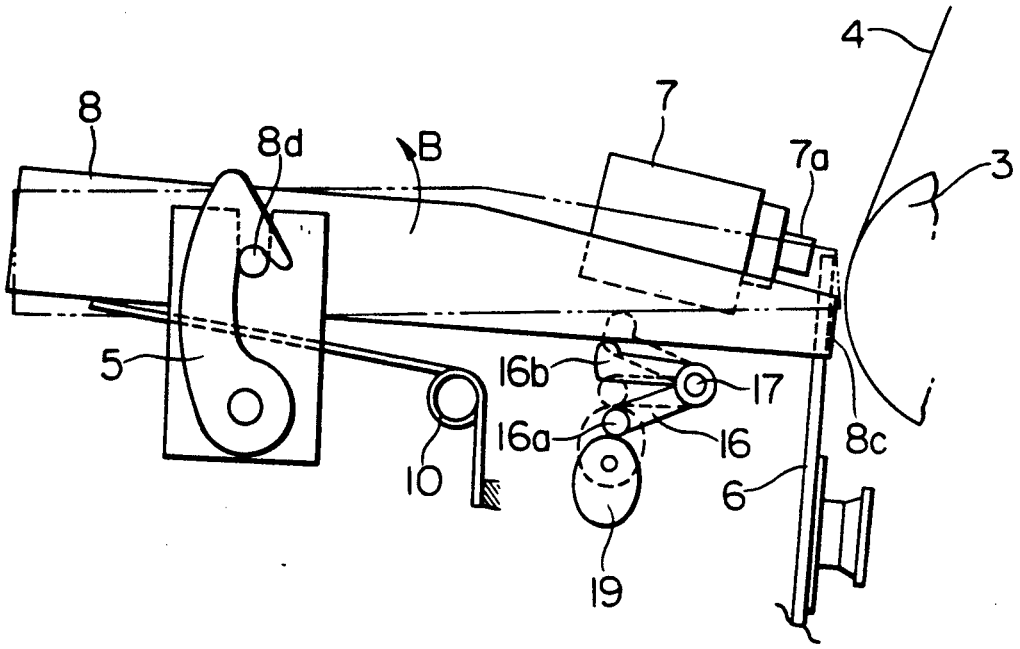
FIG. 8 is a side elevational view of the recording section in case of lifting and dropping the ribbon by means of the pulse motor and cam.

FIG. 7 is a perspective view of the recording section in case of lifting and dropping the ribbon by means of a pulse motor and a cam. FIG. 8 is a side elevational view of the recording section similarly to FIG. 7. In FIG. 7, a cam lever 16 is mounted under the bottom surface of the arm **8*b* of the print ribbon cassette 8 so as to be freely rotatable around an shaft 17 above the carriage main body 2. This lever 16 has arms 16*a* and 16*b*. The arm 16*b* is in contact with the bottom surface of the cassette arm 8*b*, while due to the weight of the cassette 8 itself, the other arm 16*a* is in contact with an eccentric cam 19 fixed to the output shaft of the pulse motor 18. Thus, the ribbon lifting and dropping operations can be performed by controlling the pulse motor 18 as shown in FIG. 8**.

Figures 11, 12:
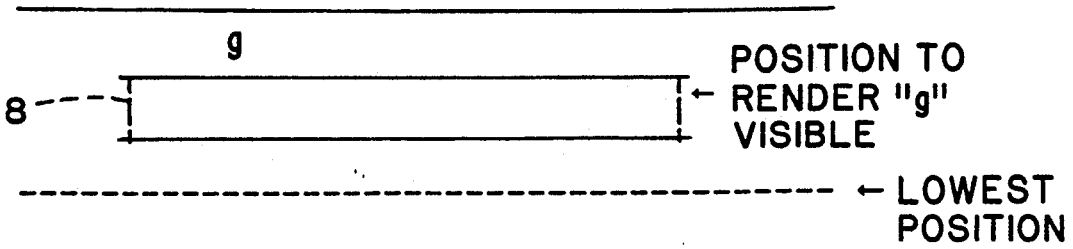
FIG. 11 is a schematic view of the ink ribbon being retracted to a position to render a character visible without being lowered to its lowestmost position.
FIG. 12 is a block diagram of control means controlling latch means to store a standard time duration different than the duration of time held by the latch means after the elapse of an extended waiting time greater than the time counted by the counting means.

Although the above description has been made with respect to the control for the lift and drop of the ribbon, it may be constituted so as to control the moving amounts in the lifting and dropping operations. In other words, in the cases where the data to be recorded is the letter "A" or the like and where it is data such as """" (i.e., a quotation mark) or the like which exists on the upper side of the area for recording one character, by merely changing the down-operating amount, there is an effect such that the recording speed is remarkably improved. This is because, in case of """", for example, it can be seen by the user without completely dropping the ribbon to its lowest position, so that the next recording operation can be quickly performed, as shown in FIG. 11.

In addition, the movements to the right and left are also similar to the above. It is obvious that the above data can be easily discriminated by the input code from the keyboard. Further, this moving amount changing method is also applied similarly to the cases where the movement is controlled through the above-mentioned solenoid or where it is controlled through the cam.

On the other hand, while the control of the time regarding the movement of the ribbon mentioned above is merely varied by the manual inputting, the time regarding the movement of the ribbon, e.g., the lift-state continuation time, down-state continuation time, movement time, etc. may be controlled by discriminating the smoothness of the stroke of the previous key input by way of measurement of the time interval between the key inputs and arithmetic logic operation on the mean value or the like. In addition, the standard time may be stored by the back-up power supply such that the time sequence is returned to the standard time after a extended waiting time interval has elapsed as shown in FIG. 12. The above description can be also similarly applied to an impact printer, a wire-dot printer, a thermal transfer copying type printer, or other printers having a hammer.

Figure 9:
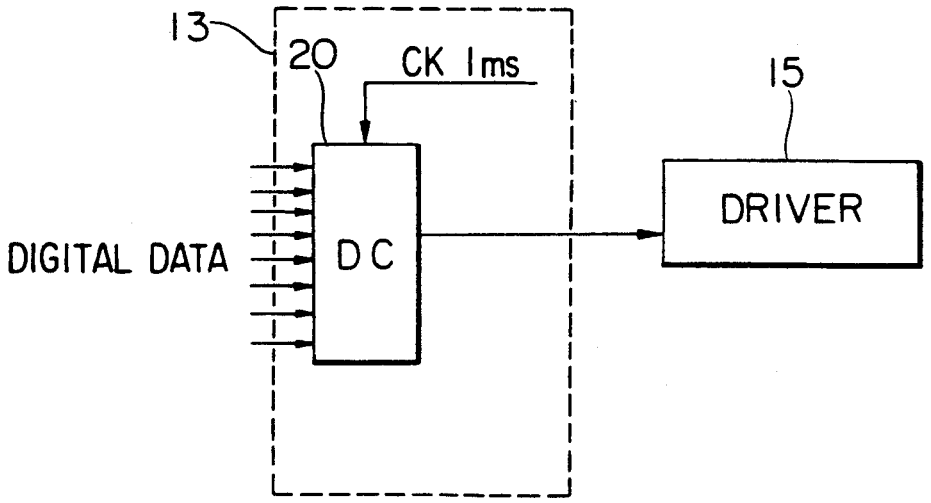
FIG. 9 is a partial detailed diagram of a controller 13.

Next, the controller 13 in FIG. 6 will be further described in detail for explaining further in detail the control for the lifting and dropping times of the ribbon. Namely, as shown in FIG. 9, the data obtained from the variable resistor 11 and A/D converter 12 is outputted to the controller 13. For instance, as shown in Table 1, in case of the dial "2", the data (e.g., "0 0 0 0 1 0 1 0") corresponding to 100 msec is outputted to the controller 13.

TABLE 11

| Variable resistor dial scale | Time (msec) |
|---|---|
| 1 | 50 |
| 2 | 100 |
| 3 | 150 |
| 4 | 200 |
| . | . |
| . | . |
| . | . |
| 18 | 900 |
| 19 | 950 |
| 20 | 1000 |

As shown in FIG. 9, in the controller 13, the above data is inputted in a down-counter 20 and a control signal is outputted from the down-counter 20 to the driver 15 for allowing the driver 15 to drive in accordance with the data. In addition, it is possible to similarly construct the invention when a ROM table as shown in Table 1 corresponding to the dial is provided.

Figure 10:
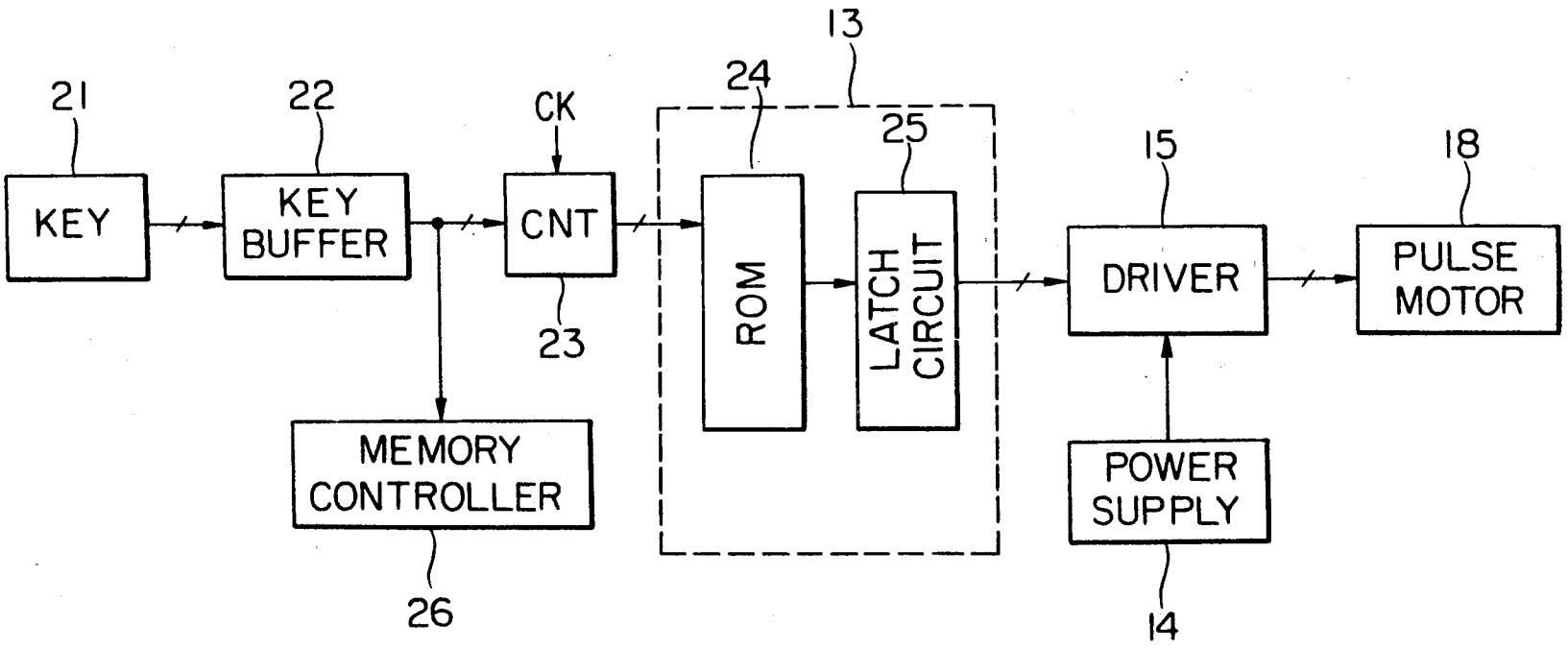
FIG. 10 is a control block diagram for the recording.

Next, the case will be explained whereby the time regarding the recording operation is changed by discriminating the smoothness of the stroke of the input of a key 21 (time interval between the key input and the next key input). FIG. 10 shows a control block diagram in which FIG. 6 is drawn in more detail. In FIG. 10, the data corresponding to the input of the key 21 is inputted to a key buffer 22. The data is sent from the key buffer 22 to a memory controller 26 such as a text memory or the like. On the other hand, a counter 23 counts how many characters are inputted as the data in the key buffer 22 within a predetermined time interval. The data corresponding to the predetermined time is outputted through a latch circuit 25 to the driver 15 at a predetermined timing on the basis of the ROM table similar to Table 1 in an ROM 24 in response to the count data. In place of the key buffer and counter, it is also possible to construct the invention such that the time interval between the key inputs is measured by a timer. Further, the time intervals of the key inputs of a plural of number of times are measured and the average time between the key inputs may be calculated.

What is claimed is:

1. An electronic typewriter adapted to operate in a character/character mode comprising:

key input means for inputting character data to be printed;

a platen;

a carriage having a printing section including an ink ribbon, movable in a first direction along said platen;

means for moving said ink ribbon in a second direction perpendicular to the first direction in which said carriage is movable so as to move said ink ribbon between up and down positions;

control means for controlling said moving means to move said ink ribbon between the up and down positions;

counting means for counting a period of time between at least two adjacent key input operations made by an operator; and latch means for holding the time counted by said counting means, wherein said control means controls said moving means such that said ink ribbon is moved by said moving means to its up position in response to input of data to be printed from said inputting means and said ink ribbon is moved to its down position in accordance with the duration of time held by said latch means, and wherein after the elapse of an extended waiting time greater than the time counted by said counting means, said control means controls said latch means to store a standard time duration different than the duration of time held by said latch means.

2. An electronic typewriter according to claim 1, wherein said moving means comprises a solenoid.

3. An electronic typewriter according to claim 1, wherein said moving means comprises a cam.

4. An electronic typewriter according to claim 3, wherein said moving means includes a motor for driving said cam and means for controlling said motor.

5. An electronic typewriter adapted to operate in a character/character mode comprising:

key input means for inputting character data to be printed;

a platen;

a carriage having a printing section including an ink ribbon, movable in a first direction along said platen;

means for moving said ink ribbon in a second direction perpendicular to the first direction in which said carriage is movable so as to move said ink ribbon in upper and lower directions, wherein said moving means comprises a pulse motor and means for driving said pulse motor;

control means for controlling said moving means to move said ink ribbon in the upper and lower directions; and setting means for setting a time duration, wherein when no key input is made during said set time duration after one key input, a down operation of said ink ribbon is started to move said ink ribbon in the lower direction;

wherein said control means controls said moving means such that when no next key input is made during the duration set by said setting means after a character has been printed on a recording area by a first key input, said ink ribbon is moved to a position to render the character visible without dropping said ink ribbon to its lower position if the character can be rendered visible without dropping said ink ribbon to its lowest position, wherein the degree of movement of said ink ribbon is dependent upon the character corresponding to character data inputted by said key input means.

6. An electronic typewriter according to claim 5, wherein said printing section includes a hammer.

7. An electronic typewriter according to claim 5, wherein said setting means comprises a dial input.

8. A method of controlling an electronic typewriter adapted to operate in a character/character mode, comprising the steps of:

inputting character data to be printed into the electronic typewriter with key input operations;

counting a period of time between at least two adjacent key input operations made by an operator in said inputting step;

holding the time counted in said counting step with latch means; and moving an ink ribbon of the electronic typewriter to its up position in response to input character data to be printed in said inputting step and moving the ink ribbon to its down position in accordance with the duration of time held in said holding step, and wherein after the elapse of an extended waiting time greater than the time held in said holding step, the latch means stores a standard time duration different than the duration of time previously held by the latch means.

* * * * *